United States Patent [19]

Hansen

[11] Patent Number: 4,490,620

[45] Date of Patent: Dec. 25, 1984

[54] ENGINE STARTER PROTECTIVE AND CONTROL MODULE AND SYSTEM

[75] Inventor: James E. Hansen, Oak Creek, Wis.

[73] Assignee: Eaton Corporation, Cleveland, Ohio

[21] Appl. No.: 531,808

[22] Filed: Sep. 12, 1983

[51] Int. Cl.[3] ..... F02N 11/08

[52] U.S. Cl. ..... 290/38 R; 290/37 A; 290/38 C; 290/38 D; 123/179 A; 123/179 BG

[58] Field of Search ..... 290/37 A, 37 R, 38, 290/38 C, 38 D, 38 E, 36 A, 36 R, DIG. 1, DIG. 3, DIG. 5, DIG. 6, DIG. 11; 123/179 A, 179 B, 179 D, 179 BG; 361/23, 241

[56] References Cited

U.S. PATENT DOCUMENTS

| | | | |
|---|---|---|---|
| 2,668,247 | 2/1954 | Short et al. | 290/36 |
| 3,440,433 | 4/1969 | Coman | 361/241 |
| 3,443,112 | 5/1969 | Huntzinger | 290/38 |
| 3,514,621 | 5/1970 | Farmer et al. | 290/37 R |
| 3,577,001 | 5/1971 | Cummins | 290/38 |
| 3,629,597 | 12/1971 | Wiley | 290/37 |
| 3,712,283 | 1/1973 | Kiess et al. | 123/179 |
| 3,783,301 | 1/1974 | Nieukirk | 290/37 |
| 3,812,378 | 5/1974 | Coman | 290/38 |
| 3,857,043 | 12/1974 | Habasch | 290/38 |
| 3,893,007 | 1/1975 | Mori | 317/9 |
| 4,045,062 | 8/1977 | Disosway et al. | 290/37 A X |
| 4,104,534 | 8/1978 | Hill et al. | 290/37 A |
| 4,198,945 | 4/1980 | Eyermann et al. | 290/37 A X |
| 4,209,816 | 1/1980 | Hansen | 361/23 |
| 4,231,073 | 10/1980 | Suchko | 290/37 R X |
| 4,236,594 | 12/1980 | Ramsperger | 290/38 E X |
| 4,296,334 | 10/1981 | Wong | 290/37 R |
| 4,345,554 | 8/1982 | Hildreth et al. | 290/37 R X |
| 4,392,059 | 7/1983 | Nespor | 123/179 BG X |
| 4,412,137 | 10/1983 | Hansen et al. | 123/179 B X |

*Primary Examiner*—J. V. Truhe
*Assistant Examiner*—Paul Shik Luen Ip
*Attorney, Agent, or Firm*—C. H. Grace; W. A. Autio

[57] ABSTRACT

An engine starter protective and control module (PCM) and system having a ½ second start speed delay timer (DT) and a 30-second crank timer (CT) that are started when a start switch (SS) is closed to control a logic circuit (L) that operates a coil driver (CD) to energize the engine starter motor (ES). An engine speed signal from an engine-driven alternator (ALT) shaped in a wave shaping circuit (WSC) is detected by a crank frequency sensor (CFS) which by-passes the delay timer (DT) to continue the cranking if the engine attains an initial speed adequate for starting, otherwise, if the battery is too low, the delay timer (DT) terminates cranking. A run frequency sensor (RFS) receives the speed signal and provides a lockout signal to the logic circuit (L) when the engine speed reaches run RPM. A crank timer (CT) started by the start switch (SS) times a 30-second cranking cycle and a 2-minute cool-off lockout interval to prevent overheating of the starter motor (ES). If the engine does not attain run RPM in 30 seconds, the crank timer (CT) provides a lockout signal that controls the logic circuit (L) to stop cranking, operates a supply switch (SSL) to provide power to the run frequency sensor (RFS), crank timer (CT) and wave shaping circuit (WSC) in shunt of the start switch (SS), and controls timing of the lockout interval whereafter the system is automatically reset.

14 Claims, 2 Drawing Figures

ENGINE STARTER PROTECTIVE AND CONTROL MODULE AND SYSTEM

BACKGROUND OF THE INVENTION

Engine starter protective and control systems have been known heretofore. For example, in my prior U.S. Pat. No. 4,209,816, dated June 24, 1980, there is disclosed a protective control for vehicle starter and electrical systems having a number of desirable features. One of these features is a reverse polarity protection circuit operable such that if the battery is connected in reverse polarity, the starter system cannot be operated. Another of these features relates to automatic disengagement of the starting function when the engine reaches a predetermined "run" speed. This is accomplished by a frequency sensor that senses the frequency of a tachometer generator driven by the engine and disengages the starter when a frequency indicative of a predetermined run condition is reached during the starting operation. And another of these features relates to prevention of reengagement of the starter while the engine is running. This is accomplished in the aforementioned patent by applying hysteresis to the frequency sensor such that it cannot be reactivated to operate the starter until the engine speed has decreased to a very small value equivalent to an almost stopped condition. Also, my copending application Ser. No. 449,072, filed Dec. 13, 1982, discloses a dual voltage engine starter management system having a number of additional desirable features. A primary feature thereof is the use of two battery packs and contactors for connecting such battery packs in series mode for cold weather starting or in parallel mode for warm weather starting and a starter contactor that controls the starter motor circuit to protect the conventional starter solenoid contacts. Another feature thereof is the use of a single sequencing timer for controlling the contactors in particular sequences, both for high and low voltage start cycles and for starting and terminating start cycles. A further feature relates to a low voltage detector that controls a start-terminate latch means to abort the start cycle if the start motor voltage is too low for effective starting whereas a frequency sensor sets the latch to end the starting cycle when the engine reaches running speed. A further feature relates to a transfer detector that sets the latch to abort the starting cycle if mode transfer is attempted during the starting cycle. An additional feature relates to weld detectors that function at the end of the start cycle to prevent reclosing of the parallel contactor if the contacts of either the series contactor or a pilot relay that controls the conventional starting solenoid have failed to open.

While these prior systems have been useful for their intended purposes, this invention relates to improvements thereover.

SUMMARY OF THE INVENTION

An object of the invention is to provide an improved engine starter protective and control module and system.

A more specific object of the invention is to provide a system of the aforementioned type that incorporates means causing disengagement of the starter during cranking if the engine does not attain a predetermined minimum speed within a predetermined initial period of cranking time.

Another specific object of the invention is to provide a system of the aforementioned type which incorporates crank time duty cycle limiting to prevent overheating of the starter motor from sustained cranking and whereby a timer allows cranking for a safe period of time whereafter the limiter locks out the cranking system to afford a cooling off period for another time interval whereafter cranking can again be initiated.

Another specific object of the invention is to provide a system of the aforementioned type incorporating lockout means in the crank time duty cycle limiter such that if the start switch is held closed for the duration of the cooling off period, nothing will happen at the end thereof until the start switch is opened and then reclosed whereupon cranking will again be initiated.

Another specific object of the invention is to provide a system of the aforementioned type that incorporates in the crank time duty cycle limiter an internal solid state switch which is operated simultaneously with establishment of the cooling off period to supply operating power to the crank time duty cycle limiter even if the start switch which normally supplies operating power thereto is open.

Another specific object of the invention is to provide a system of the aforementioned type which incorporates reverse battery polarity protection which prevents operation of the starter system thereby to prevent the module from being damaged by reverse polarity.

Another specific object of the invention is to provide a system of the aforementioned type that incorporates automatic starter disengagement during cranking when the run speed is attained so as to prevent starter motor overrun.

Another specific object of the invention is to provide a system of the aforementioned type that incorporates run lockout which prevents reengagement of the starter when the engine is running.

Another specific object of the invention is to provide a system of the aforementioned type that incorporates the above features in combination.

Other objects and advantages of the invention will hereinafter appear.

DESCRIPTION OF THE PREFERRED EMBODIMENT

A general functional description of the invention will be given first with reference to the block diagram in FIG. 1 followed by a more detailed operational description in connection with the circuit diagram in FIG. 2.

Figure 1:
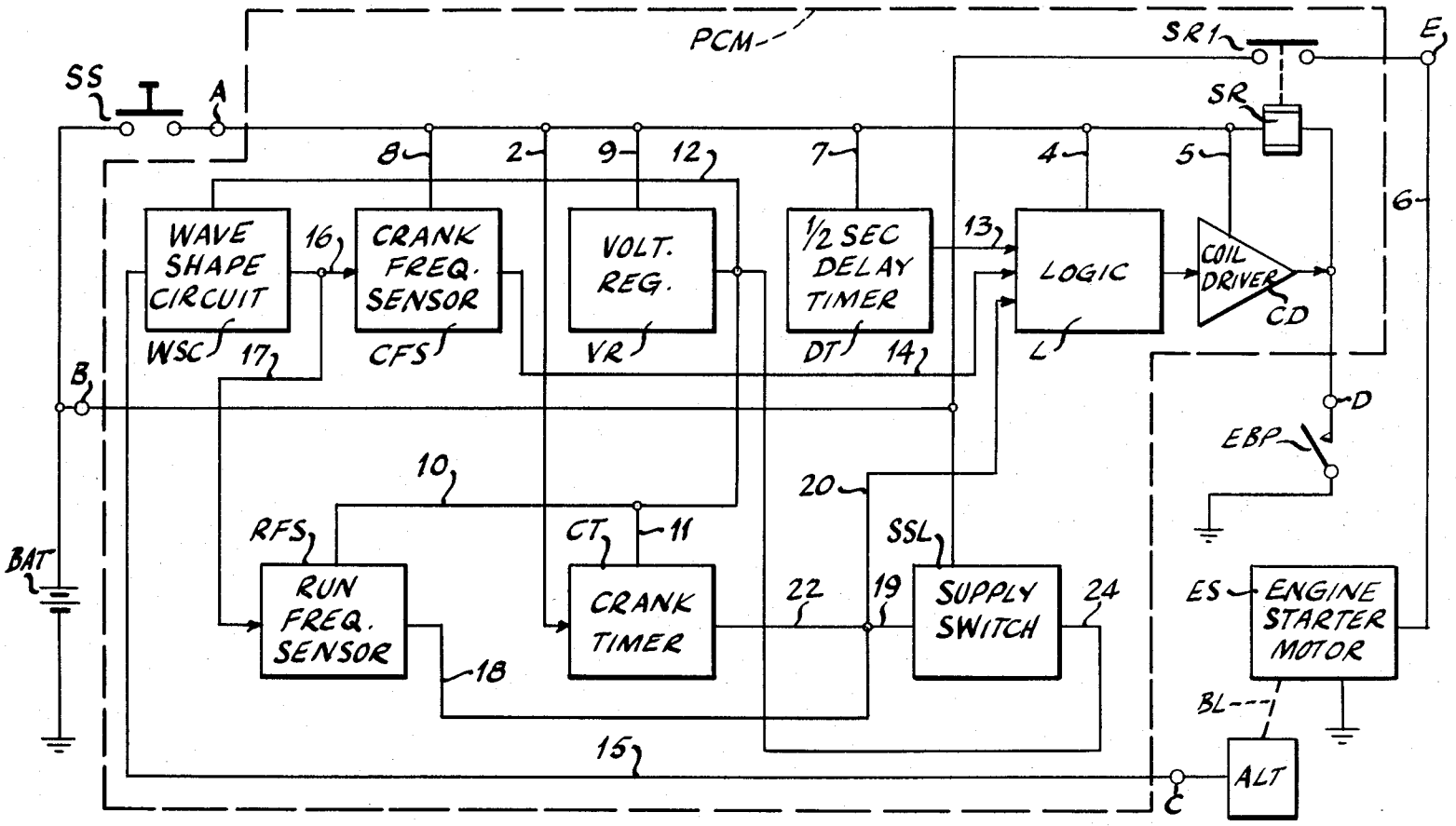
FIG. 1 is a block diagram generally illustrating an engine starter protective and control module and system in accordance with the invention.

Referring to FIG. 1, there is shown a protective and control module PCM having a plurality of terminals including a terminal A to which D.C. voltage may be applied from a battery BAT through a start switch SS. D.C. voltage is applied directly from battery DC to terminal B. Terminal C is used to receive an engine speed signal in the form of an A.C. wave generated by an alternator ALT driven by the engine as generally depicted by the broken line BL. Terminal D has an emergency bypass switch EBP connected thereto for grounding this terminal so that start relay SR can be energized by merely closing start switch SS without the assistance of the logic and coil driver circuit. Terminal E is the output terminal of protective and control module PCM whereby the engine starter ES is energized when start relay contact SR1 is closed.

Operative features provided by the protection and control module PCM include:

1. Automatic starter disengagement during cranking when the run RPM is attained to prevent starter motor overrun.
2. Run lockout, that is, preventing reengagement of the starter when the engine is running.
3. Automatic dropout of starter shortly after initiation of cranking if the engine is not being cranked fast enough to achieve a start condition. This situation would usually occur if the batteries were too low in charge to crank the engine and termination of cranking is desirable to prevent starter solenoid chattering, contact welding, etc., as well as further depletion of the batteries which, although too weak to crank engine, may still have enough charge for other uses such as communications equipment.
4. Starter motor duty cycle limiting. This is a protection to prevent overheating of the starter motor from sustained cranking intervals when an engine fails to start. This will lock out the starter for a period of approximately two minutes after it has been cranked for a period of approximately 30 seconds, for example. This equates to approximately a 20% permissible cranking duty cycle. It has been theorized that if the engine would not start within 30 seconds of cranking, it would not start for some time anyway.
5. The starter protector and control module provides power relay contacts capable of switching the starter solenoid current. The start command signal is initiated from a conventional switch. The vehicle utilizes an alternator unit which provides a special internal tap inside of its rectifier bridge. The A.C. signal voltage sensed at this tap varies in frequency as the running RPM of the alternator changes. This frequency signal can be used to determine the engine speed or RPM.

A typical starting sequence begins by closure of the start switch SS which will apply power from battery BAT through terminal A to the circuit initiating the following operations. Power is also applied from battery BAT directly to terminal B to supply power to parts of the module when switch SS is open, the effect of which will become apparent to the description proceeds. Since the engine initially is not running, the A.C. signal input from alternator ALT to terminal C. will be zero. At the same time, through conductor 2 the start switch signal at terminal A will initiate operation of crank timer CT which will begin to accumulate the time that the start signal is on. The start signal at terminal A will also power-up logic circuit L through conductor 4 and coil driver CD through conductor 5 to initially energize the coil of start relay SR which will close its contact SR1 thereby to energize engine starter motor ES through conductor 6 as hereinafter described. The engine will thus begin to crank immediately upon first closure of start switch SS.

Power is also applied from terminal A at the same time through conductor 7 to ½-second delay timer DT and through conductor 8 to crank frequency sensor CFS. Also, power is supplied from terminal A through conductor 9 to voltage regulator VR and then through conductor 10 to run frequency sensor RFS, through conductor 11 to crank timer CT and through conductor 12 to wave shaping circuit WSC.

Upon initial closure of start switch SS as aforesaid, ½-second delay timer DT biases logic circuit L into an "on" state such that coil driver CD causes energization of the coil of start relay SR and closure of contact SR1, this signal from delay timer DT being applied through conductor 13 to logic circuit L. The purpose of delay timer DT is to initiate the cranking operation but to terminate the same to prevent further depletion of the battery if the engine speed does not reach a predetermined minimum RPM during the time interval of delay timer DT which indicates that the battery is too low to achieve a start. If the engine speed does reach such minimum RPM, biasing of logic circuit L will then be taken over by crank frequency sensor CFS through conductor 14 so as to continue the cranking function. While delay timer DT has been indicated as being a ½-second timer, it will be apparent that its time period can be set at what is suitable.

As soon as the engine starts rotating and drives alternator ALT, this alternator will put out an A.C. signal through terminal C and conductor 15 to a wave shaping circuit WSC. This wave shaping circuit WSC is used because the A.C. signal supplied by the alternator does not have a clean and uniform wave shape but instead varies in magnitude, particularly during the starting interval with which the present invention is concerned. This wave shaping circuit WSC shapes the wave to a uniform square wave which is then applied through conductors 16 and 17 to both crank frequency sensor CFS and run frequency sensor RFS as shown in FIG. 1.

As hereinbefore mentioned, the delay timer DT biases logic circuit L into an "on" state upon initial start switch closure but at the end of the time interval of delay timer DT, if the engine has not attained a minimum RPM as detected by the crank frequency sensor CFS which measures the alternator ALT output frequency, the logic circuit L will trip or latch off, deenergizing start relay SR. The crank frequency sensor circuit requires that the engine RPM attain a certain minimum level within the first ½ second of cranking, indicating that the batteries have sufficient electrical charge and therefore are adequate to crank the engine properly, and, if the RPM is sufficient, the crank frequency sensor will then provide logic circuit L with bias to retain closure of start relay SR after the ½-second delay timer time expires. This will then permit cranking to continue until certain other conditions occur as hereinafter described.

One of these conditions is that the engine speed reaches a "run" RPM state where the alternator output frequency attains a level high enough to cause the run frequency sensor RFS to provide an output signal through conductors 18 and 19 to supply switch SSL and through conductor 20 as a trip signal to logic circuit L to terminate cranking. Under this condition, cranking is no longer needed as the engine is running. Another of these conditions is that cranking has been sustained for a 30 second duration at an engine speed above the crank frequency sensor output point but below the run frequency sensor output point. At this time, it should be apparent that upon initial closure of start switch SS as hereinbefore described, crank timer CT started timing a 30 second interval. While a 30 second interval is described for exemplary purposes, it will be apparent that this interval may be adjusted as desired for required conditions. Once the time limit of crank timer CT has been reached without the engine reaching a run speed, crank timer CT will time out and provide a lockout signal through conductors 22 and 19 to supply switch SSL and through conductor 20 to logic circuit L to cause start relay SR to be deenergized and thereby terminate the cranking operation.

Immediately thereupon, crank timer CT will start timing a 2 minute lockout interval which will prevent cranking regardless of the start switch state, that is, whether it is opened and reclosed. Here again, while a 2 minute lockout interval has been described for exemplary purposes, it will be apparent that such lockout interval may be adjusted as desired to provide the necessary cooling off period so as to avoid damage to the engine starter. Another one of these conditions and one which is related to the last mentioned condition is that cranking is being sustained during the aforementioned 30 second interval but the engine does not start and then the cranking speed or RPM drops below the minimum crank frequency sensor CFS threshold level at which time the latter will provide the aforementioned signal through conductor 14 to cause logic circuit L to be biased off, opening the start relay. Cranking can then be resumed by opening and reclosing the start switch, but again, the cranking must be above the crank frequency sensor threshold level at the end of ½ second, that is, the delay period of timer DT, or cranking will again be terminated as hereinbefore described.

Supply switch SSL is operated by either crank timer CT or run frequency sensor RFS to maintain power on necessary parts of the protective and control module PCM when start switch SS is open. It will be recalled from the foregoing description that crank timer CT times a 30 second interval during which cranking is permitted to continue and, if the engine does not reach a run condition during that 30 second interval, cranking will then be locked out for a 2 minute cooling off period which is timed by crank timer CT. At the start of such 2 minute time interval, crank timer CT applies a lockout signal through conductors 22 and 19 to turn "on" supply switch SSL which then supplies operating power from terminal B through its output conductor 24 and then through conductor 10 to run frequency sensor RFS, and through conductor 12 to wave shaping circuit WSC and through conductor 11 to crank timer CT. This is to ensure that these necessary circuits will continue to function in the event the operator opens and recloses start switch SS in an attempt to start the engine during the 2 minute lockout interval.

Assuming that the engine reaches its run speed during the 30 second time interval of crank timer CT, run frequency sensor RFS will sense this run RPM and will apply a signal through conductors 18 and 20 to logic circuit L to cause deenergization of start relay SR and discontinuance of the starting operation. Run frequency sensor RFS will also apply a signal through conductor 19 to supply switch SSL. As a result, supply switch SSL connects operating power from terminal B through its output conductor 24 and conductor 10 to run frequency sensor RFS which will then be powered from terminal B in addition to being powered through start switch SS, terminal A, conductor 9 and voltage regulator VR. Therefore, when the start switch is opened, run frequency sensor RFS remains powered "on" through its own action as long as it detects that the engine is in a running condition. If the engine is stopped, however, the output of run frequency sensor RFS at its output conductor 18 will allow supply switch SSL to reopen to disconnect power from the system. The advantage of disconnection of power from the system at this stage is that nonrunning current draw from the battery into the circuit will reduce to virtually zero, preventing long term battery depletion when the engine is not running.

Having described the operation of the protective and control module PCM generally in connection with FIG. 1, the structure and operation of this module will now be described in more detail in connection with FIG. 2. Referring to FIG. 2, it will be apparent that terminal A is at the upper right-hand portion of the figure, terminal B is at the right central portion of the figure, terminal C is at the left upper portion of the figure and terminal D is at the right portion of the figure above terminal B. Terminal E shown as the output terminal of the module at the upper right-hand portion of FIG. 1 is not shown in FIG. 2 since the contact of start relay SR is not shown therein. As shown in FIG. 1, battery is permanently connected to terminal B at the right central portion of FIG. 2 and battery may be connected to terminal A by closure of the start switch. After the motor starts, terminal C receives A.C. voltage from alternator ALT in FIG. 1.

Application of D.C. voltage to terminal A by closure of the start switch causes energization of start relay SR to initiate the cranking operation. For this purpose, current flows from terminal A through reverse battery protection diode D4 and resistor R17 into the base of coil driver amplifier NPN transistor Q5 to cause it to conduct through its collector emitter circuit and thereby energize the operating coil of relay SR as long as NPN transistor Q4 is nonconductive. Transistor Q4 does not conduct initially because capacitor C8 is at zero charge and because NPN transistor Q3 is conducting as follows. Current flows from terminal A through diode D4, resistors R12, R10 and R11 and diode D2 into the base of transistor Q3 to keep it conducting while delay timer DT operates. Within timer DT, initially, programmable unijunction transistor Q2 is nonconductive because capacitor C7 is at a zero charge level whereby the gate G of transistor Q2 is at a voltage above its anode A potential thereby keeping transistor Q2 in an "off" state. As capacitor C7 charges, the gate voltage of transistor Q2 drops and when it reaches the level of its anode voltage set by voltage divider resistors R10 and R11, the anode A to cathode C circuit of transistor Q2 turns on, resulting in the anode dropping to near the cathode voltage level or ground G. The values of resistors R8 and R9 and capacitor C7 are chosen to produce a ½ second delay to trigger transistor Q2. Prior to transistor Q2 turning on, the reference voltage divider branch of resistors R10 and R11 had current flowing through it and through D2 into the base of transistor Q3, keeping transistor Q3 turned on. When transistor Q2 turns on as hereinbefore described, the current is diverted from resistor R11 through transistor Q2 to ground. Therefore, this source of transistor Q3 base current turns off. At the end of the ½ second time interval following application of power to terminal A, base current to transistor Q3 must be supplied from crank frequency sensor CFS or the start relay SR will be deenergized, as hereinafter described.

The manner in which transistor Q3 will be maintained conducting by crank frequency sensor CFS after the time interval of timer DT has elapsed will now be described. As described in connection with FIG. 1, as soon as the engine starts rotating and starts turning alternator ALT, an A.C. signal is applied through terminal C to wave shaping circuit WSC at the upper left-hand portion of FIG. 2. The A.C. signal supplied by the alternator does not have a clean wave shape and it varies in magnitude particularly during the starting interval with which the present invention is concerned. Resistor R2 limits current to the base of NPN transistor Q1 and also forms with resistor R1 and capacitor C1 an RC noise filter connected across the base and emitter of transistor Q1. The alternator signal is fed via terminal C through this network to the base of transistor Q1 which is thereby switched on and off by the signal. The collector of transistor Q1 switches on and off (low and high) on the leading and trailing edges of the signal applied to its base, providing a square wave signal of constant amplitude which is more suitable to be fed to the frequency selective circuitry CFS to be described hereinafter. Resistor R3 is connected in parallel with capacitor C1 across the transistor base-emitter circuit to provide a base to emitter return path to aid turn-off of the transistor. Resistor R4 is a collector load, or pull-up, resistor and is connected between the transistor collector and the voltage supply coming from terminal A. Resistor R5 and capacitor C2 provide A.C. coupling from the transistor Q1 collector to the input terminal 11 of crank frequency sensor CFS. Crank frequency sensor CFS is a programmable frequency switch IC1 which will provide a signal going from low to high at its output terminal 3 when its input signal rises to a predetermined frequency. In this crank frequency sensor, programmable frequency switch IC1 is an integrated circuit such as for example a Motorola MC3344 integrated circuit of the like. The same standard pin designations assigned to an MC3344 type integrated circuit are used in FIG. 2 to facilitate clarity for the description to follow.

The pulse waveform from the collector of transistor Q1 is fed to input 11 of frequency switch IC1 and the output off-to-high transition signal goes from its terminal 3 to the base of transistor Q3. Output 3 of frequency switch IC1 is off as long as the incoming frequency at input 11 is below a predetermined set point of threshold frequency which may be determined as hereinafter described. As the engine is started and its speed increases to a running or idling level, the frequency of the input signal to terminal 11 of frequency switch IC1 reaches the set point at which output terminal 3 switches from low to high voltage thereby maintaining transistor Q3 conducting before delay timer DT times out.

The frequency of the set or switching point of switch IC1 is determined by the values of resistor R6 and capacitor C3. Special type components are used for resistor R6 and capacitor C3 to provide excellent frequency stability for the cutout set or switching point of frequency at which the programmable frequency switch is designed to switch over from low to high at its output 3. This switch point remains very closely at the set frequency over a wide temperature range of operation.

Other components in crank frequency sensor circuit CFS include resistor R7 which limits the output current from output 3 to the base of transistor Q3, and capacitor C4 which is part of an additional integrator network used in the operation of crank frequency sensor CFS.

Now it will be seen from the foregoing that if the crank frequency sensor determines that adequate engine RPM is attained within ½ second, cranking of the engine will be permitted to continue. Subsequently, if the RPM of the engine reaches a "start" condition, run frequency sensor RFS which includes another programmable frequency switch IC2 will terminate cranking in the following manner. When the start frequency condition is reached, output 3 of programmable frequency switch IC2 will go from off to high and this signal will be applied to conductor 18 and resistor R33 to the base of transistor Q4 thereby to bias transistor Q4 on, turning transistor Q5 off and thus deenergizing relay SR and terminating operation of the engine starter ES. This would represent a normal starting sequence.

Figure 2:
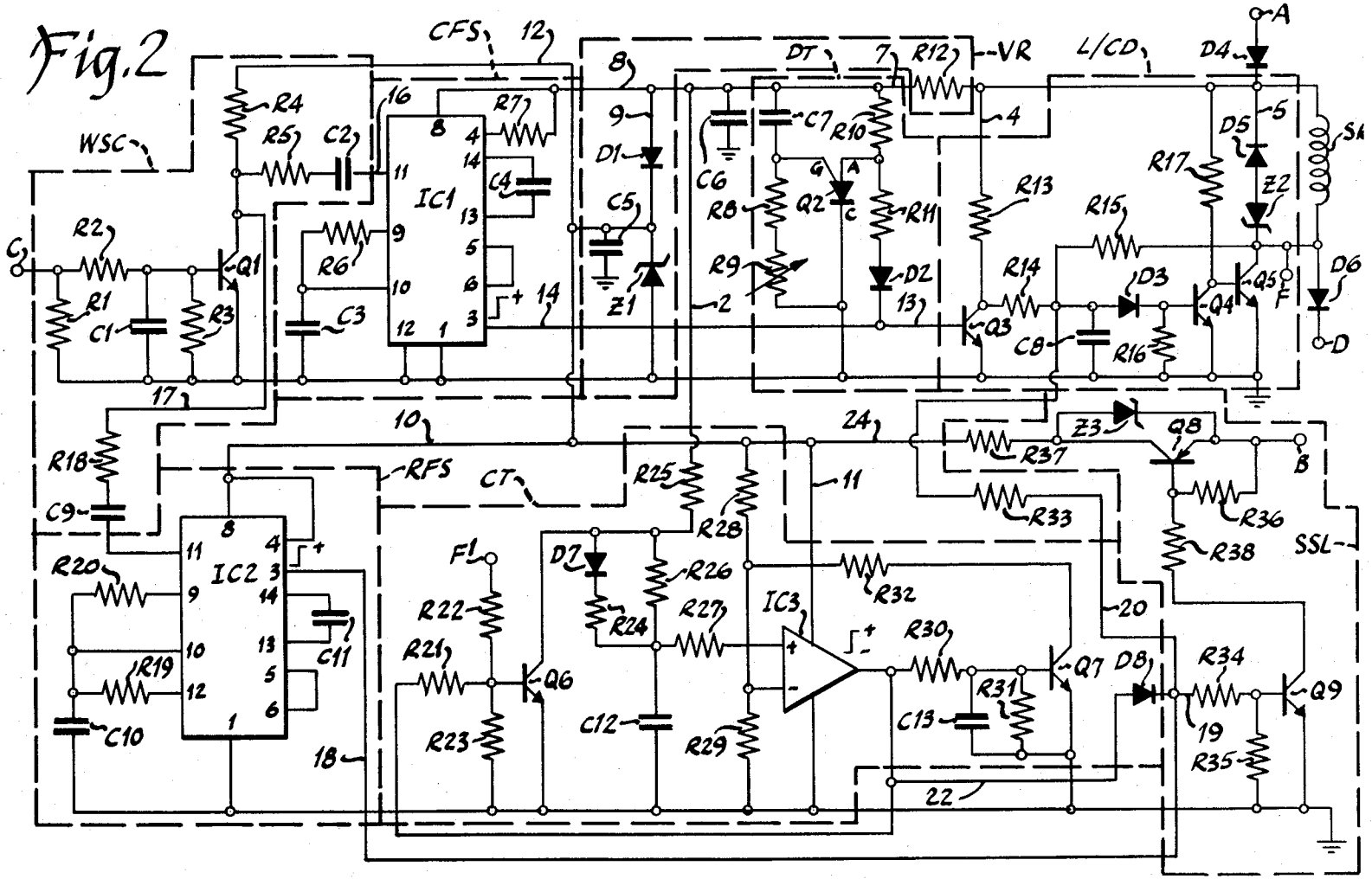
FIG. 2 is a more detailed circuit diagram of the protective and control module of FIG. 1.

A run lockout feature is incorporated in the circuit of FIG. 2. For this purpose, if the engine were already running when the start switch SS is closed, frequency switch IC2 would have detected this condition and having the base of transistor Q4 already biased "on" as hereinbefore described would thus prevent even a brief closure of start relay SR. This run lockout feature is an essential function of the system. Whenever the engine is running, it is necessary that frequency switch IC2 receive operating power so that it can constantly keep the base of transistor Q4 "on", locking out any chance of relay closure by the start switch. Since the overall circuit receives its operating power through the start switch itself, it is therefore necessary to provide an additional source of power to certain portions of the circuit such as frequency switch IC2 when the engine is running. This is accomplished by the solid state power supply switch SSL shown at the lower right-hand portion of FIG. 2 and comprising PNP transistor Q8 and NPN transistor Q9, resistors R34, R35, R36, R37 and R38 and zener diode Z3.

The manner in which this solid state power supply switch SSL operates will now be described. The protective and control module PCM first receives its supply power by way of start switch SS. Once the motor is running, the run lockout signal coming from output pin 3 of frequency switch IC2 not only biases transistor Q4 "on" to terminate the starting cycle, but also biases the base of transistor Q9 "on" through conductors 18 and 19 and resistor R34. Transistor Q9's collector then turns "on" the base of transistor Q8 through resistor R38. The emitter of transistor Q8 is connected to the main battery input at terminal D. Thus, when transistor Q8 turns on, its collector switches to positive D.C. battery potential. The run frequency sensor circuit RFS is then powered up through resistor R37 and conductors 24 and 10 and is regulated by a zener diode Z1 and is powered also from the start switch through diode D4, resistor R12 and diode D1. When the start switch SS (FIG. 1) is opened, however, frequency switch IC2 remains powered "on" through its own action by keeping transistor Q8 conducting as long as it detects that the engine is in a running condition. If the engine is stopped, however, the output of frequency switch IC2's output terminal 3 will go low, transistor Q8 will turn off and nonrunning current draw from the battery into the circuit will reduce to virtually zero, preventing long term battery depletion when the engine is not running.

The protective and control module provides crank time duty cycle limiting. This will prevent burnout of the starter motor if excessive cranking is attempted. If cranked for 30 seconds continuously, it will latch off, preventing further cranking for 2 minutes as a cool-off period for the starter motor. Also, intermittent-repetitive cranking intervals of less than 30 seconds will be accumulated in a manner such that if the duty cycle exceeds approximately that described above, it will also latch off for 2 minutes. For example, several short crank intervals of 10 seconds "on" and 10 seconds "off" will be accumulated to somewhat more than a sum of 30 seconds total "on" time prior to lockout occurrence.

For this purpose, crank timer circuit CT limits cranking time as follows. When the start switch is closed and transistor Q5 is "on" (start relay SR energized) timing capacitor C12 is charged up from zero volts through terminal A, diode D4, resistors R12 and R25 and then in parallel through resistor R26 in one branch and diode D7 and resistor R24 in the other branch at a rate such that if sustained continuously for 30 seconds, it would reach a voltage and apply it through resistor R27 to the noninverting input of operational amplifier or comparator IC3 equal to the reference voltage provided at its inverting input by the divider action of resistors R28 and R29. Once capacitor C12 reaches this level of voltage, that is, a voltage above the reference voltage at the inverting input, it will cause the output of comparator IC3 to toggle high as a lockout signal. Once this happens at about 30 seconds after start of cranking, the high output of comparator IC3 is applied through conductor 22, diode D8, conductor 20, resistor 33, an diode D3 to the base of transistor Q4 to turn transistor Q4 on, turn transistor Q5 off and deenergize start relay SR, terminating cranking. The high output of comparator IC3 also turns "on" supply switch SSL thus causing itself to retain supply power even after start switch SS is opened. This high will be applied through conductor 22, diode D8 and resistor 34 to the base of transistor Q9 to keep transistor Q9 and also transistor Q8 "on" as long as the output of comparator IC3 is high. Crank timer CT will keep the start function locked out regardless of the start switch action, that is, opening and reclosing the start switch SS will not reset the circuit until the timer itself resets. Once the crank timer reaches this lockout state and comparator IC3 output goes high, biasing "on" transistor Q4 as described above, it also applies this high through resistor R30 to the base of NPN transistor Q7 to turn it on. Resistor R32 has a much smaller resistance value than resistor R29 so that when transistor Q7 turns on, it pulls the reference voltage at the inverting input of comparator IC3 substantially downward as a hysteresis function, aiding the latch action. The output of comparator IC3 is also applied through resistor R21 to the base of NPN transistor Q6 to turn this transistor on. When transistor Q6 turns on, the timing capacitor C12 discharges through resistor R26 and transistor Q6 to ground, regardless of whether the start signal exists or not. The discharge rate of capacitor C12 is determined only by resistor R26 because resistor R24 is blocked on discharge by diode D7. Therefore, the discharge rate is much less than the charge rate and resistor R26 is selected in value to produce a discharge time of approximately 2 minutes before capacitor C12 charge decays to the voltage existing at the reference inverting input of comparator IC3. When the charge on capacitor C12 reaches this level, the output of comparator IC3 toggles low, reestablishing initial conditions and, if the start switch SS is reclosed, the cranking sequence can be resumed. If the start switch has been held closed when the 2 minute lockout timed out, nothing would happen until it is opened and reclosed; that is due to the latching action of the logic circuit through resistor R15 and prevents any "surprises". That is, when transistor Q5 was turned off during the 2 minute time interval and the start switch was kept closed, current flow through resistor R15 keeps capacitor C8 fully charged and keeps transistor Q4 turned on so that transistor Q5 remains off even when the output of comparator IC3 toggles from high to low. Therefore, it is necessary to open start switch SS before another cranking cycle can be initiated by reclosing the same.

It will be noted that terminal F connected to the anode of transistor Q5 in the upper right-hand portion of FIG. 2 is connected to terminal F' in crank timer circuit CT. The purpose of this connection is to prevent charging of capacitor C12 whenever the start switch is closed but start relay SR is tripped open for some reason. This keeps the crank timer reset and prevents unwanted accumulation of charge of timing capacitor C12 and thereby interfering with the crank timing operation of 30 seconds.

As was the case of run frequency sensor frequency switch IC2 keeping transistor Q8 on only as long as a run state is being detected, this crank timer CT circuit will also keep transistor Q8 on only while it is in the 2 minute lockout mode. In this connection, it will be apparent that diode D1 at the upper central portion of FIG. 2 prevents the supply power through transistor Q8 from being supplied to any of the circuitry except the necessary sections, that is, run frequency switch IC2, comparator IC3 including transistor Q7 and wave shaping circuit WSC, when the main power from the start switch at point A is off.

When the start switch is closed for periods less than 30 seconds but is then opened for a period of time, and then reclosed, timing capacitor C12 in crank timer CT discharges during the open interval through resistors R26 and R25 and the circuitry connected to the junction at conductors 8 and 9 which is now at a low state. Thus, since some discharge occurs during the off time, capacitor C12 will allow more than a summed cranking time of short cranking periods to total more than 30 seconds before lockout occurs. It all depends on the ratio of "on" and "off" times applied to the start switch as to how fast capacitor C12 will accumulate charge to the comparator IC3 toggle point. If the crank time versus open time ratio remains below a certain percentage, capacitor C12 will never reach the toggle level and lockout will not occur. The purpose of this timer is to prevent starter motor overheating and if the applied duty cycle is low enough, it will not overheat no matter how frequently it is cranked. Thus, the circuit will permit over 30 seconds of shorter cranking intervals to accumulate as long as some off periods occur on the start switch. The crank time accumulation is actually measured as cranking time rather than the duration that the start switch is closed. For example, the start switch may be held closed but cranking may not occur for other reasons such as frequency switch IC2 detecting a run state or frequency switch IC2 detecting an insufficient crank RPM. This is achieved by the action of resistor R22 connected through terminals F and F' between the collector of transistor Q5 and the base of transistor Q6. If transistor Q5 is turned off (start relay SR open) even though the start switch is still closed, capacitor C12 will not accumulate charge. Thus transistor Q5 must be "on" before transistor Q6 will allow the capacitor C12 to charge.

Resistor R20 and capacitors C10 and C11 connected to frequency switch IC2 have functions similar to those described in connection with frequency switch IC1 and resistor R6 and capacitors C3 and C4 associated therewith. Resistor R19 connected between terminals 10 and 12 of frequency switch IC2 provides hysteresis of input frequency around the switch point, that is, the frequency at which its output 3 switches off is lower than the frequency at which its output 3 switches on. This is desirable at the run frequency point to prevent reenergization of the starter in the event the run frequency drops slightly.

While the apparatus hereinbefore described is effectively adapted to fulfill the objects stated, it is to be understood that the invention is not intended to be confined to the particular preferred embodiment of engine starter protective and control module and system disclosed, inasmuch as it is susceptible of various modifications without departing from the scope of the appended claims.

I claim:

1. A protective system supplied from a battery for controlling an engine starter motor comprising:

a control system for said starter motor;

a start switch for connecting supply power from said battery to said control system and for controlling said starter motor to cause cranking rotation of the engine;

and said control system comprising:

a crank timer responsive to operation of said start switch for timing a time interval at the end of which cranking of the engine will be stopped;

starter motor control means responsive to operation of said start switch for energizing the starter motor to start cranking of the engine and for simultaneously starting said crank timer;

speed detector means responsive to rotation of the engine for providing an engine speed signal;

run speed sensor means responsive to said speed signal indicating that the engine has attained a predetermined run speed for taking over control of the starter motor from said crank timer so as to control said starter motor control means to stop cranking;

means responsive to said run speed sensor means to connect supply power from said battery in shunt of said start switch to said run speed sensor means to keep the latter operative and prevent reoperation of said starter motor by opening and reclosing said start switch while the engine is running;

and electronic means responsive to said crank timer at the end of its time interval if the engine has not reached said predetermined run speed for operating said starter motor control means to deenergize the starter motor.

2. The protective system supplied from a battery for controlling an engine starter motor claimed in claim 1, wherein:

said control system comprises a start speed timer that comprises means for timing an initial time interval at the end of which cranking will be stopped if the engine does not attain a crank speed adequate for starting due to low battery charge or the like;

and said crank speed is a start RPM indicative that the engine is being cranked fast enough normally to achieve a start.

3. The protective system supplied from a battery for controlling an engine starter motor claimed in claim 2, wherein:

said control system comprises a crank frequency sensor responsive to said speed signal when the engine attains said start RPM for controlling said starter motor control means to maintain energization of the starter motor despite said start speed timer reaching time-out at the end of said initial time interval.

4. The protective system supplied from a battery for controlling an engine starter motor claimed in claim 1, wherein:

said crank timer comprises a duty-cycle timer that comprises means for timing the maximum cranking time interval permissible without overheating the starter motor at the end of which cranking will be stopped and locked out for a predetermined cool-off time interval;

and said predetermined run speed is a run RPM indicative that the engine is rotating fast enough to afford termination of cranking.

5. The protective system supplied from a battery for controlling an engine starter motor claimed in claim 1, wherein:

said speed detector means responds to stopping of the engine for terminating said speed signal;

and said run speed sensor comprises means responsive to said termination of said speed signal for restoring said supply switch means to disconnect battery power from said protective system including said run speed sensor thereby to keep nonrunning current draw from the battery into said protective system at virtually zero thus preventing long term battery depletion when the engine is not running.

6. The protective system supplied from a battery for controlling an engine starter motor claimed in claim 1, wherein:

said crank timer comprises means for timing the maximum continuous cranking cycle time permissible without overheating the starter motor;

said electronic means comprises logic means responsive to time-out of said crank timer time interval for stopping said cranking cycle;

said crank timer comprising means operable simultaneously with said stopping of said cranking cycle for starting the timing of a cool-off time interval and for controlling said electronic means to lock out the starter motor for such cool-off time interval regardless of operation of said start switch;

and means in said crank timer operable at the end of said cool-off time interval for restoring said electronic means to afford reoperation of the starter motor under the control of said start switch.

7. The protective system supplied from a battery for controlling an engine starter motor claimed in claim 6, wherein:

said electronic means comprises a supply switch responsive to said time-out of said crank timer time interval for supplying operating power from the battery directly to said crank timer to keep it operative during said cool-off time interval in the event of restoration of said start switch.

8. The protective system supplied from a battery for controlling an engine starter motor claimed in claim 6, wherein:

said electronic means comprises latch means effective if said start switch has been kept closed during said cool-off time interval for preventing automatic reenergization of the starter motor at the end of said cool-off time interval thereby to require opening and reclosing of said start switch to enable reoperation of the starter motor.

9. The protective system supplied from a battery for controlling an engine starter motor claimed in claim 6, wherein:

said crank timer comprises:

a voltage comparator having input, reference and output terminals;

means providing a reference signal at said reference terminal;

a timing circuit operable when started by said operation of said start switch for applying an increasing input signal to said input terminal such that when it exceeds said reference signal, said comparator provides an output signal at said output terminal at said time-out of said crank timer time interval;

said logic means responding to said output signal to stop said cranking cycle;

and hysteresis means responsive to said output signal for lowering said reference signal so that said input signal must be decreased that much lower before said output signal is terminated;

and means responsive to said output signal for operating said timing circuit so as to decrease said input signal below said lowered reference signal thereby to time said cool-off period.

10. The protective system supplied from a battery for controlling an engine starter motor claimed in claim 6, wherein:

said crank timer comprises a two-rate add-subtract energy storage timer that simulates the heat build-up and decay experienced within the starter motor that accumulates energy at one rate during the occurrence of motor cranking and discharges energy at a different rate upon termination of cranking such that if cranking occurs for shorter periods than said maximum continuous cranking cycle that are interrupted by noncranking periods, said timer will afford a summed cranking time to total more than said maximum continuous cranking cycle before lockout occurs.

11. A protective system supplied from a battery for controlling an enginel starter motor comprising:

a start switch effective when operated for controlling the starter motor to cause cranking rotation of the engine;

a start speed timer for timing an initial time interval at the end of which cranking will be stopped if the starter motor does not rotate the engine fast enough for starting due to low battery charge or the like, said timer being started responsive to operation of said start switch;

logic means and power control means operated thereby also responsive to operation of said start switch for energizing the starter motor to start cranking the engine;

means responsive to said cranking of the engine for providing an engine speed signal;

start speed sensor means responsive to said speed signal when the engine reaches a start RPM adequate for engine starting for by-passing said start speed timer in order to control said logic means to cause said power control means to maintain energization of the starter motor, said start speed timer operating at the end of said initial time interval to trip said logic means to cause said power control means to deenergize the starter motor if the engine has not reached said start RPM;

run speed sensor means responsive to said speed signal when the engine reaches a run RPM for providing a run lockout signal for tripping said logic means to cause said power control means to deenergize the starter motor;

a crank timer responsive to operation of said start switch for timing a predetermined cranking time interval that does not overheat the starter motor followed by a lockout time interval allowing the starter motor to cool enough preparatory to another cranking cycle and for providing a start lockout signal at the end of said cranking time interval and for terminating said lockout signal at the end of said lockout time interval;

said logic means being tripped responsive to said lockout signal for controlling said power control means to deenergize said starter motor;

and a supply switch responsive to either said run lockout signal or said start lockout signal for supplying operating power from the battery directly to said run speed sensor and said crank timer to maintain them operative in the event said start switch is opened.

12. The protective system supplied from a battery for controlling an engine starter motor claimed in claim 11, wherein:

said logic means comprises latch means effective at the end of said lockout time interval when said lockout signal terminates for controlling said power control means to prevent automatic reenergization of the starter motor in the event the start switch remains closed at the end of said lockout time interval.

13. The protective system supplied from a battery for controlling an engine starter motor claimed in claim 11, wherein:

said crank timer comprises an RC circuit for charging in a first circuit in response to said operation of said start switch to time said cranking time interval and for discharging in a second circuit responsive to said lockout signal to time said lockout time interval;

and discharge switch means in said crank timer responsive to said lockout signal for completing said second discharge path.

14. The protective system supplied from a battery for controlling an engine starter motor claimed in claim 13, wherein:

said logic circuit comprises means effective whenever said logic circuit is tripped and said start switch is closed for operating said discharge switch means to prevent charging of said RC circuit.

* * * * *